US005295762A

United States Patent [19]

Lopez et al.

[11] Patent Number: 5,295,762

[45] Date of Patent: Mar. 22, 1994

[54] MARINE LOCK SYSTEMS AND METHODS

[75] Inventors: Eudoro Lopez, Miami; James R. McNew, Vero Beach, both of Fla.

[73] Assignee: Locks and Waterways International, Inc., Vero Beach, Fla.

[21] Appl. No.: 107,637

[22] Filed: Aug. 18, 1993

Related U.S. Application Data

[63] Continuation-in-part of Ser. No. 877,987, May 4, 1992, abandoned, which is a continuation-in-part of Ser. No. 920,427, Nov. 20, 1986, abandoned.

[51] Int. Cl.[5] ..... E02C 5/00

[52] U.S. Cl. ..... 405/86; 405/1; 405/3; 405/85

[58] Field of Search ..... 405/1, 3, 4, 84, 85, 405/86

[56] References Cited

U.S. PATENT DOCUMENTS

| | | | |
|---|---|---|---|
| 457,528 | 8/1891 | Dutton | 405/86 |
| 557,564 | 4/1896 | Dutton | 405/86 |
| 557,566 | 4/1896 | Dutton | 405/86 |
| 2,103,871 | 12/1937 | Rothmund | 405/86 |
| 2,968,929 | 1/1961 | Jermar | 405/86 |
| 3,390,530 | 7/1968 | Toben | 405/86 |

FOREIGN PATENT DOCUMENTS

| | | | |
|---|---|---|---|
| 4476 | of 1887 | United Kingdom | 405/86 |

*Primary Examiner*—David H. Corbin
*Attorney, Agent, or Firm*—Carroll F. Palmer

[57] ABSTRACT

A method of operation of marine locks includes the steps of supporting a first column of water within a lock chamber upon a vertically movable first floor, supporting a second column of water within a balance chamber upon a vertically movable second floor, supporting the first and second floors upon a confined volume of compressed air communicated between the lock chamber and the balance chamber and causing the first floor to rise or fall by application of upward or downward hydraulic pressure on the first floor while causing the second floor to move in the opposite direction by application of contrary hydraulic pressure on the second floor. Lock systems to perform the new methods are disclosed.

11 Claims, 5 Drawing Sheets

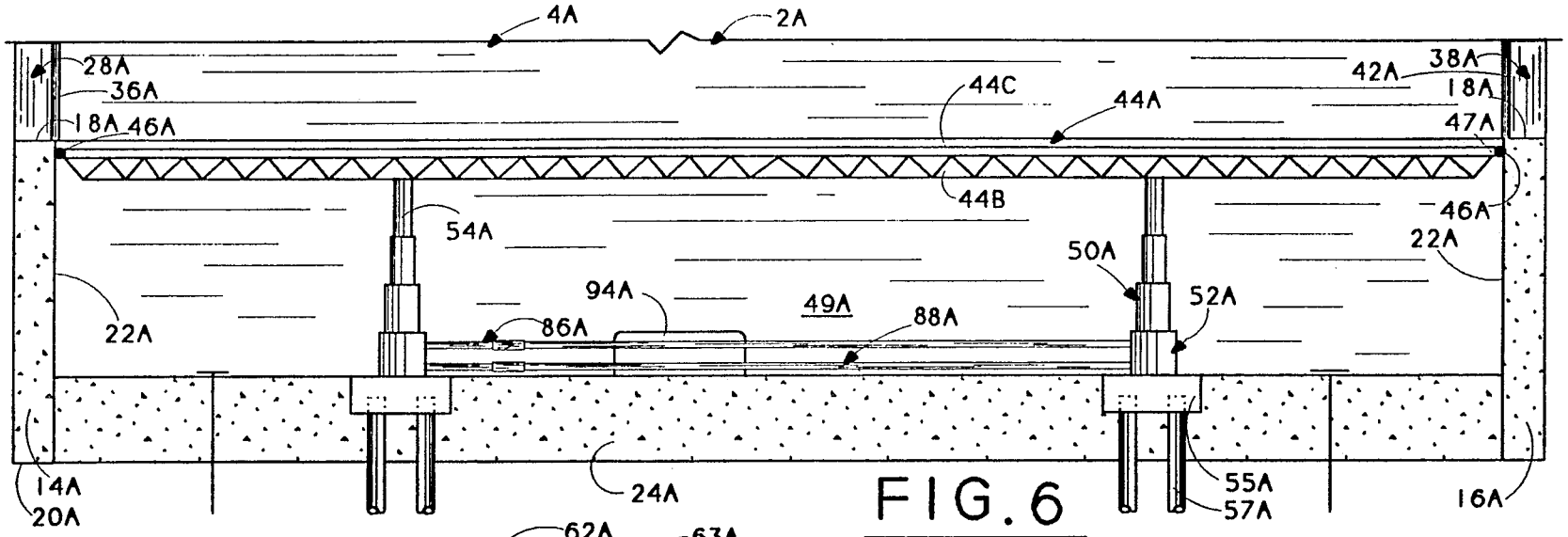
FIG. 6
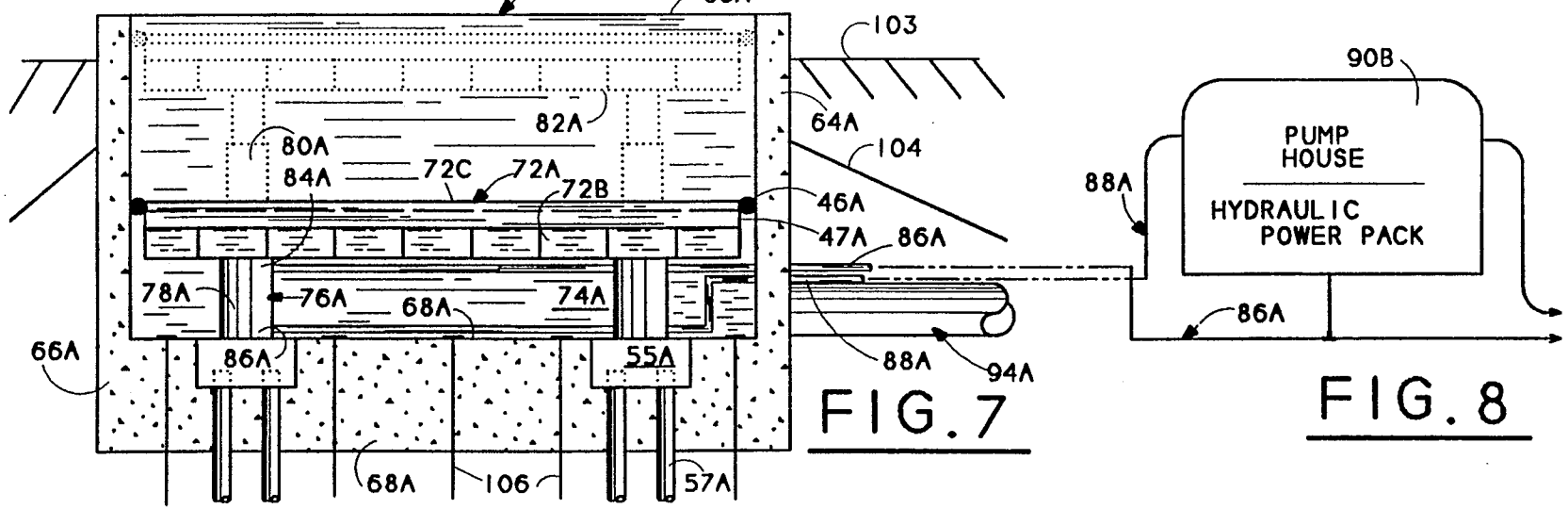
FIG. 7
FIG. 8

MARINE LOCK SYSTEMS AND METHODS

CROSS-REFERENCE TO RELATED APPLICATIONS

This application is a continuation-in-part of copending application Ser. No. 07/877,987, filed May 4, 1992, now abandoned, which, in turn, is a continuation-in-part of abandoned application Ser. No. 06/920,427, filed Nov. 20, 1986.

BACKGROUND OF THE INVENTION

1. Field of the Invention

This application relates to improved marine lock systems and to new methods for operation of such lock systems. More particularly, it concerns unique marine lock systems that, unlike conventional lock systems, do not require vast quantities of high side water for their operation.

2. Description of the Prior Art

Conventional marine lock systems operate on the basis of allowing water from a high side to flow by gravity into or out of the lock chamber until surface elevations are equal. Thus, in the case of a ship entering from the high side, gates are opened to allow the ship to enter the chamber. The gates are then closed and water it allowed to flow out of the chamber to the low side until the chamber surface elevation is equal to the low side level. The low side gates are then opened to allow the ship to exit into the lower elevation body of water. The result of this is that the volume of water required to fill the chamber is detrimentally lost to the low side, typically, from a fresh water source into a saline water body, with an obvious environmental loss.

Ships entering from the low side are lifted by means of water being allowed to flow in the same direction, from high to low, effectively using for each operation a vast amount of water to expand or reduce a column of water in the lock chamber with each locking cycle between the high side and low side. By way of example of the magnitude of water required by such conventional methods of lock operation, in the case of the Panama Canal, this averages 52 million gallons of fresh water per ship. The fresh water available for such operations is a limited resource and canal locks compete for it against many other essential needs.

In contrast, balanced lock systems (BLS) do not depend on flow of water from a high side source for elevation changes. Instead, a BLS lock chamber confines a water column of relatively fixed volume which, per se, is moved in operation of the lock system between the high and low levels.

Although BLS have no significant use in world-wide existing canals and other waterways, they have long been known as shown by U.S. Pat. Nos. 457,528; 557,564; 557,566 & 2,103,871 and G.B. patent No. 4,476/1887. This indicates that, while the ability of BLS to conserve water has certainly been long apparent to concerned persons, their real world use has been almost or totally repressed, by inefficient and complicated mechanisms that have been know heretofore to raise and lower very large, fixed volume water columns repeatedly between marine lock high and low levels. The present invention addresses this long existing problem and provides the world with a new efficient and uncomplicated balanced lock systems and methods.

OBJECTS

A principal object of the invention is the provision of new, improved marine lock systems and new methods for operation of marine lock systems.

Further objects include the provision of:

1. New marine lock systems and methods that obtain close to 100% conservation of water use as compared with the amount of water consumed by each locking cycle of conventional lock systems.

2. Such new systems and methods that operate in faster locking cycles than conventional lock systems.

3. Such new systems and methods that mitigate salt water intrusion into fresh water estuaries by lock operation, thereby reversing the current trend of decline in access to inland navigation by off-shore vessels.

4. Such new systems and methods that can allow non-turbulent passage of endangered species, e.g., manatees, from saline habitats to natural breeding grounds in fresh water estuaries to thereby reduce the kill rates of such species at man-structured interchanges between these separate habitats.

5. Systems for enabling vessels traversing waterways of a height greater than the fixed clearance of crossing bridges to pass such bridges without need for them to be of the opening type, e.g., draw bridges, or to be built to an expensive height, such as 65 feet clearance.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished, in part, in accordance with the invention by the provision of a balanced marine lock system comprising a lock chamber defined by a pair of longitudinal parallel vertical walls, a pair of vertical gated end walls, a horizontal first bottom whose periphery joins with the vertical walls and the end walls and an open top.

There is a horizontal, vertically movable first floor within the lock chamber having an area conforming to, but slightly less, than the horizontal cross-sectional area of the lock chamber and inflatable gasket means is assoicated with the periphery of such first floor to prevent liquid supported thereby from flowing below its level and to form a variable volume first pressure compartment between the first floor and the first bottom.

The lock chamber further comprises first hydraulic means to positively raise and lower the first floor within the lock chamber.

In addition, the lock system comprises a balance chamber defined by a pair of vertical side walls, a pair of vertical end walls, a horizontal second bottom whose periphery joins with the balance chamber vertical walls and end walls and a open top.

There is a horizontal, vertically movable second floor within the balance chamber having an area conforming to, but slightly less, than the horizontal cross-sectional area of the balance chamber and inflatable gasket means is associated with the periphery of the second floor to prevent liquid supported thereby from flowing below its level and to form a variable volume second pressure compartment between the second floor and the second bottom.

The balance chamber further comprises second hydraulic means to positively raise and lower the second floor and conduit means connecting the first pressure compartment to the second pressure compartment for flow of pressurized air between them.

In preferred embodiments, the first hydraulic means includes a pluality of double-action first hydraulic cylinders, the second hydraulic means includes a plurality of double-action second hydraulic cylinders and the first hydraulic cylinders are connected by vertical piston rods to the underside of the first floor while the second hydraulic cylinders are connected by vertical piston rods to the underside of the second floor.

Further, each of the first and second hydraulic cylinders contain a pull chamber that imparts a downward pull on its respective piston rod plus a push chamber that imparts an upward push on its respective piston rod and the pull chambers of all the first and second hydraulic cylinders are connected together by first conduit means for fluid flow therebetween. Additionally, the push chambers of all the first and second hydraulic cylinders are connected together by second conduit means for fluid flow therebetween and the second conduit means includes pump means for forcing fluid from the first hydraulic cylinders to the second hydraulic cylinders or vis versa.

The objects are further accomplished, in part, in accordance with the invention by the provision of a method of operation of marine locks which comprises (a) supporting a first column of water within a lock chamber upon a vertically movable first floor, (b) supporting a second column of water within a balance chamber upon a vertically movable second floor, (c) supporting the first and second floors upon a confined volume of compressed air communicated between the lock chamber and the balance chamber. In a first mode of the operation, the first floor is caused to rise by application of upward hydraulic pressure on the first floor while causing the second floor to descend by application of downward hydraulic pressure on the second floor.

In a second mode of the operation, the first floor is caused to descend by application of downward hydraulic pressure on the first floor while causing the second floor to rise by application of upward hydraulic pressure on the second floor.

In preferred methods of the invention, the applications of hydraulic pressure are obtained by first double-action hydraulic cylinders attached to the first floor and second double-action hydraulic cylinders attached to the second floor.

BRIEF DESCRIPTION OF THE DRAWINGS

A more complete understanding of the invention can be obtained by reference to the accompanying drawings in which:

FIG. 6 is a sectional view taken on the line VI—VI of FIG. 5.

FIG. 7 is a sectional view taken on the line VII—VII of FIG. 5.

FIG. 8 is a diagrammatic view of a component of the lock system shown in FIG. 5.

DESCRIPTION OF THE PREFERRED EMBODIMENTS

Figure 1:
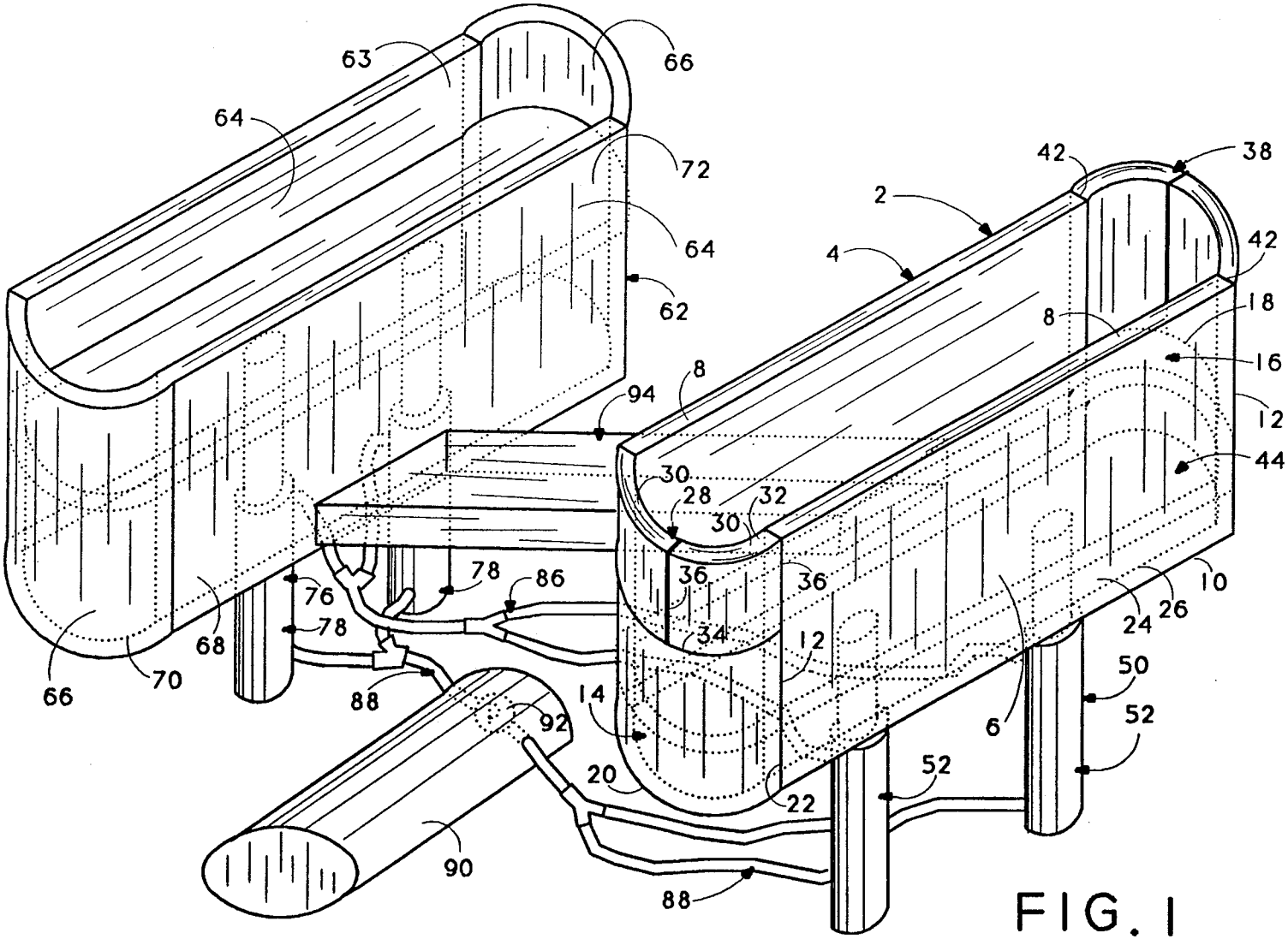
FIG. 1 is an isometric view, partially in phantom, of one embodiment of a lock system of the invention.
Figure 2:
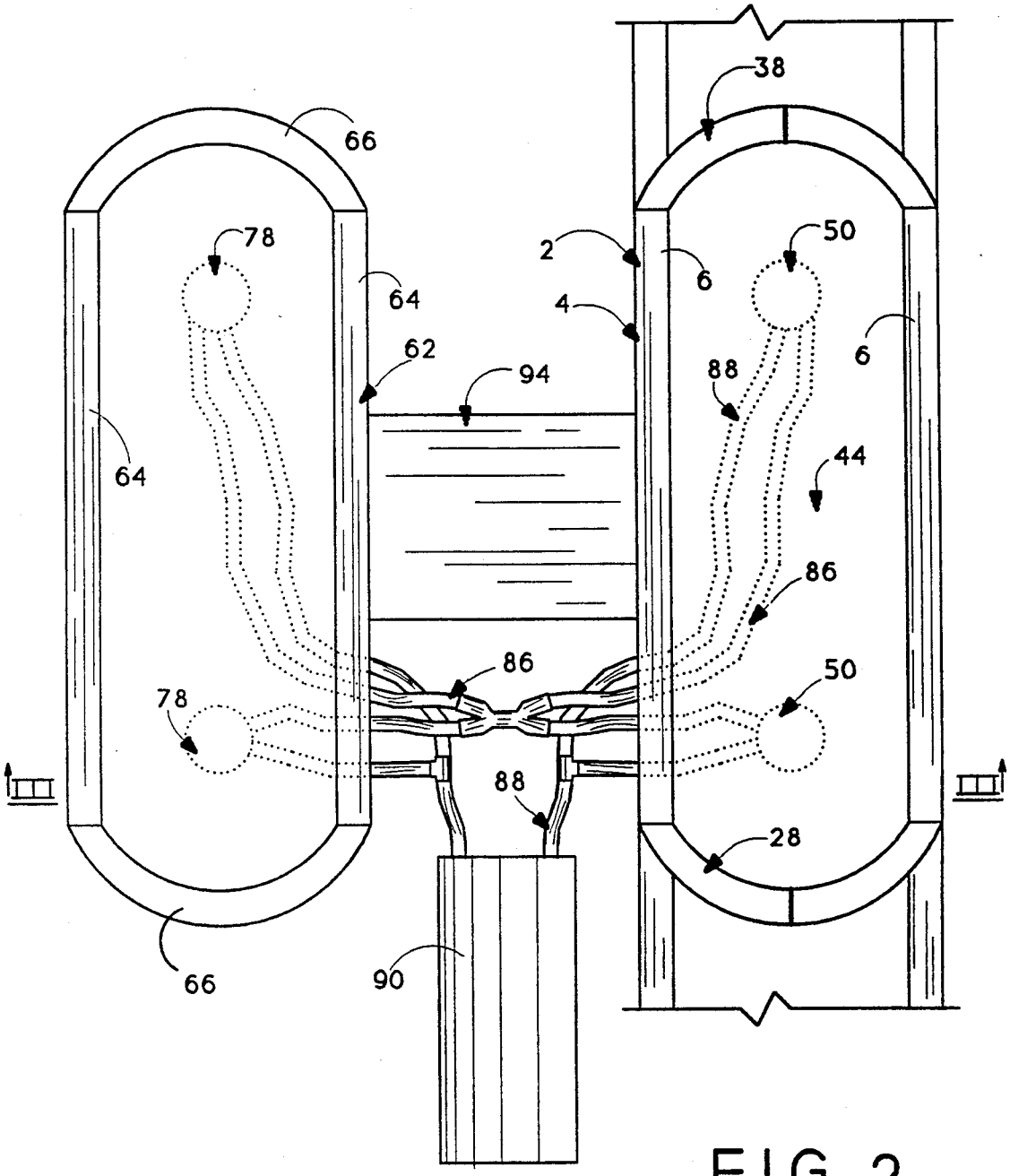
FIG. 2 is a plan view, partially in phantom, of the lock system of FIG. 1, with hydraulic components thereof further sectioned.
Figure 3:
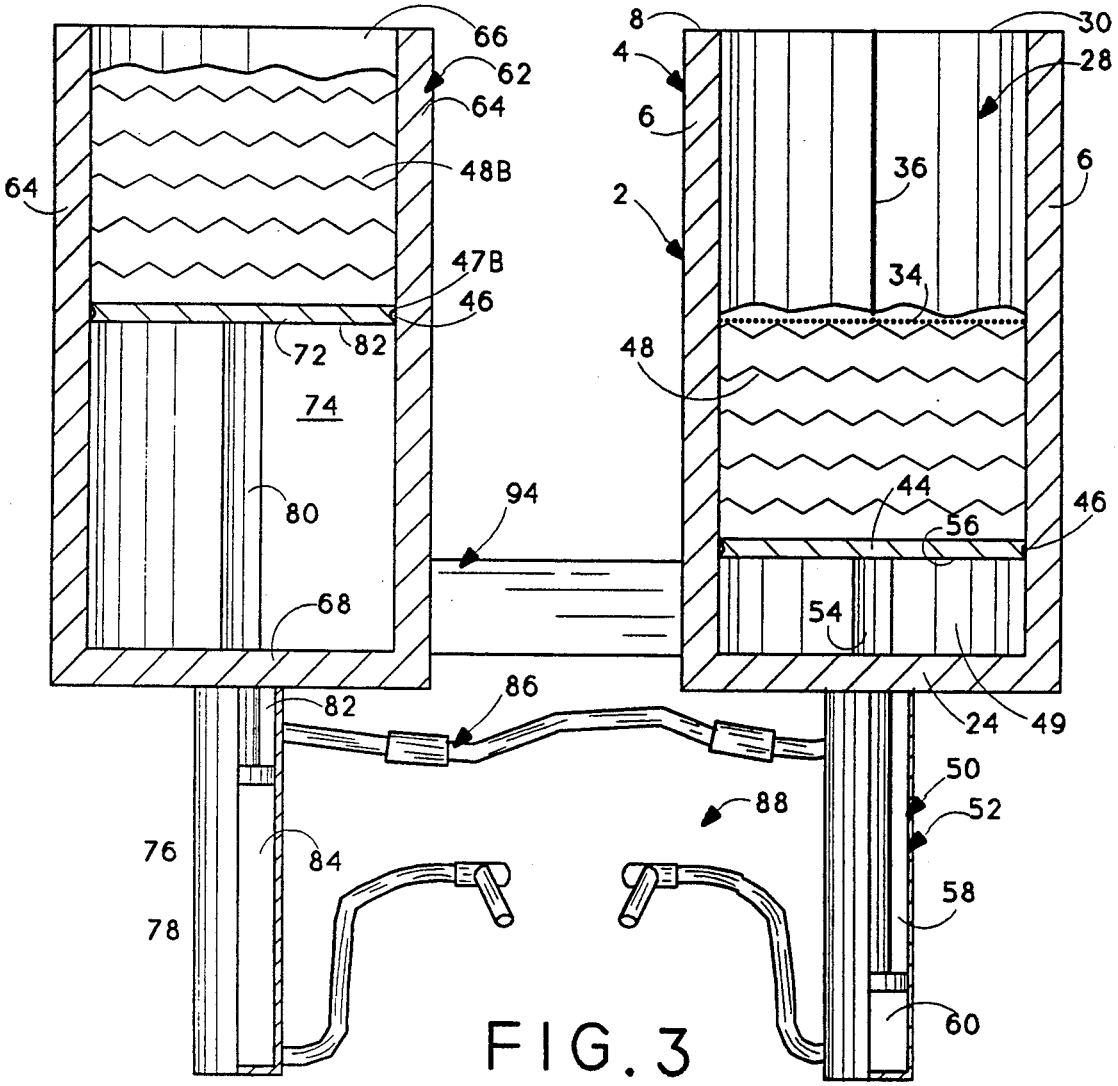
FIG. 3 is a lateral sectional view taken on the line III—III of FIG. 2.
Figure 4:
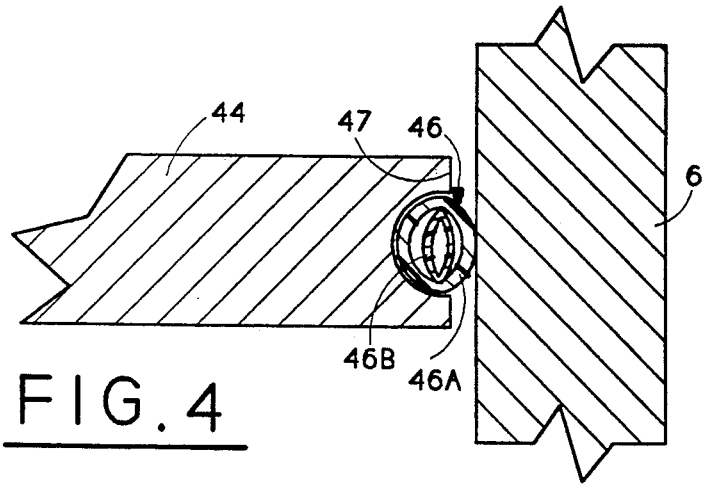
FIG. 4 is an enlarged, sectional view of a liquid sealing means between a vertically moveable floor and a wall of a lock chamber of the invention.

Referring in detail to the drawings, a first embodiment of a balanced marine lock system 2 of the invention comprises a lock chamber 4 defined by a pair of parallel vertical rectangular elongated walls 6 each bounded by longitudinal top edges 8, bottom edges 10 and opposed vertical first sides 12.

There is a first end wall 14 and a second end wall 16 each bounded by top edges 18 and bottom edges 20 shorter in length than the edges 8, 10 of walls 6 and opposed vertical second sides 22 of lesser height than the sides 12 of the walls 6.

The second sides 22 are joined to the first sides 12 with the bottom edges 10 and the shorter bottom edges 20 all lying in a horizontal plane.

A horizontal first bottom 24 whose periphery 26 joins with the walls 8, 10 and the end walls 14, 16 creates the lock chamber 4.

A first gate 28 includes a pair of doors 30 each bounded by top edges 32 and bottom edges 34 and vertical sides 36 of height equal to the height of the first sides 12 of the walls 6 minus the height of the second sides 22 of the end walls 14. Each door 30 is hinged at its a side 36 to a side 12 of the wall 6 above the top edge 18 of the end wall 14.

A second gate 38 includes a pair of doors 40 each constructed like the first gate 28 and hinged at a side 42 to a side 12 of the walls 6 above the top edge 18 of the second end wall 16.

A horizontal, vertically movable first floor 44 is positioned within the lock chamber 4. It has an area conforming to, but slightly less, than the horizontal cross-sectional area of the lock chamber 4.

Inflatable gasket means 46 is associated with the periphery 47 of the floor 44 to prevent liquid 48 supported thereby from flowing below its level and to form a variable volume first pressure compartment 49 between the floor 44 and the bottom 24. Such gasket means preferably comprises a plurality of nested bladders 46A, 46B formed of elastomeric material and equipped with inflation valves (not shown), with the outer surface of the outside bladder 46A being coated with polytetrafluorethylene or equivalent lubricant layer (not shown).

First hydraulic means 50 is included to positively raise and lower the first floor 44. Means 50 includes a plurality of double-action first hydraulic cylinders 52 connected by vertical piston rods 54 to the underside 56 of the floor 44. The cylinders 52 contain a pull chamber 58 that imparts a downward pull on its respective piston rod 54 and a push chamber 60 that imparts an upward push on its respective piston rod 54.

The lock system 2 also comprises a balance chamber 62 that is defined by an open top 63, a pair of vertical side walls 64, a pair of vertical end walls 66, a horizontal second bottom 68 whose periphery 70 joins with the balance chamber side walls 64 and end walls 66.

There is a horizontal, vertically movable second floor 72 within the balance chamber 62 having an area conforming to, but slightly less, than the horizontal cross-sectional area of the balance chamber. The area and weight of floor 72 are substantially equal to the area and weight of floor 44.

Inflatable gasket means 46 is associated with the periphery 47B of the second floor 72 to prevent liquid 48B supported thereby from flowing below its level and to form a variable volume second pressure compartment 74 between the floor 72 and the bottom 68.

Second hydraulic means 76 serves to positively raise and lower the second floor 72. Means 76 includes a plurality of double-action second hydraulic cylinders 78 connected by vertical piston rods 80 to the underside 82 of the floor 72. The cylinders 78 contain a pull chamber 82 that imparts a downward pull on its respective piston rod 80 and a push chamber 84 that imparts an upward push on its respective piston rod 80. The pull chambers 58 of all the first cylinders 52 are connected by first conduit means 86 to all the pull chambers 82 of second hydraulic cylinders 78 for fluid flow therebetween.

The push chambers 60 of all the first hydraulic cylinders 52 are connected to the push chambers 84 of the second hydraulic cylinders 78 by second conduit means 88 for fluid flow therebetween. The conduit means 88 includes a hydraulic pressure unit 90 with pump means 92 for forcing fluid from the first hydraulic cylinders 52 to the second hydraulic cylinders 78 or vis versa.

Conduit means 94 connects the first pressure compartment 49 of lock chamber 4 to the second pressure compartment 74 of the balance chamber 62 for flow of pressurized air between them as the floors 44 & 72 are raised or lowered by their respective hydraulic means 50 & 76.

In the method of operation of lock system 2, a first column of water 48 is supported within lock chamber 4 upon floor 44, while a second column of water 48B is supported within balance chamber 62 upon a vertically movable second floor 72. The heights of water columns 48 and 48B are substantially equal.

At the same time, the first floor 44 and second floor 72 are supported upon a volume of compressed air confined in pressure compartments 49 and 74 plus the conduit means 94 communicating between the lock chamber 4 and the balance chamber 62. The heights and volumes of compartments 49 and 74 are substantially equal.

In a first mode of the operation, the first floor 44 is caused to rise by application of upward hydraulic pressure thereon from push chambers 60 of hydraulic means 50 while causing the second floor 72 to descend by application of downward hydraulic pressure thereon from pull chamber 82 of hydraulic means 76. In this manner, a ship (not shown) floating on the column of water 48 will be raised from a low entrance level to a high exit level of the lock system 2.

In a second mode of operation, the first floor 44 is caused to descend by application of downward hydraulic pressure thereon from pull chambers 58 of hydraulic means 50 while causing the second floor 72 to ascend by application of upward hydraulic pressure thereon from push chamber 84 of hydraulic means 76. In this manner, a ship (not shown) floating on the column of water 48 will be lowered from a high entrance level to a low exit level of the lock system 2.

By way of example in a lock system 2, the lengths of chambers 4 and 62 would be 650′ and the widths 50′ while the columns of water 48 & 48B would be 25′ deep. The air pressure required to operate in the pressure compartments 49 & 74 and conduit means 94 is given by the formula:

$$P = W_1 + W_2/A$$

where $W_1$ = weight of water column in lbs.
$W_2$ = weight of moveable floor in lbs.
A = area of moveable floor in sq. inches
P = air pressure in psi
$W_1 = (650)(50)(25)(62.4) = 50{,}700{,}000$ lbs.
$W_2 = 10{,}000{,}000$ lbs.
$A = (650)(50)(144) = 4{,}680{,}000$
$P = 60{,}700{,}000/4{,}680{,}000 = 12.97$ psi.

In the case of lock systems, e.g., the Panama canal, designed to handle supertankers requiring water column depths substantially greater than 25′, the air pressure in such lock systems will be slightly greater than about 13 psi, but less than 20 psi.

Figure 5:
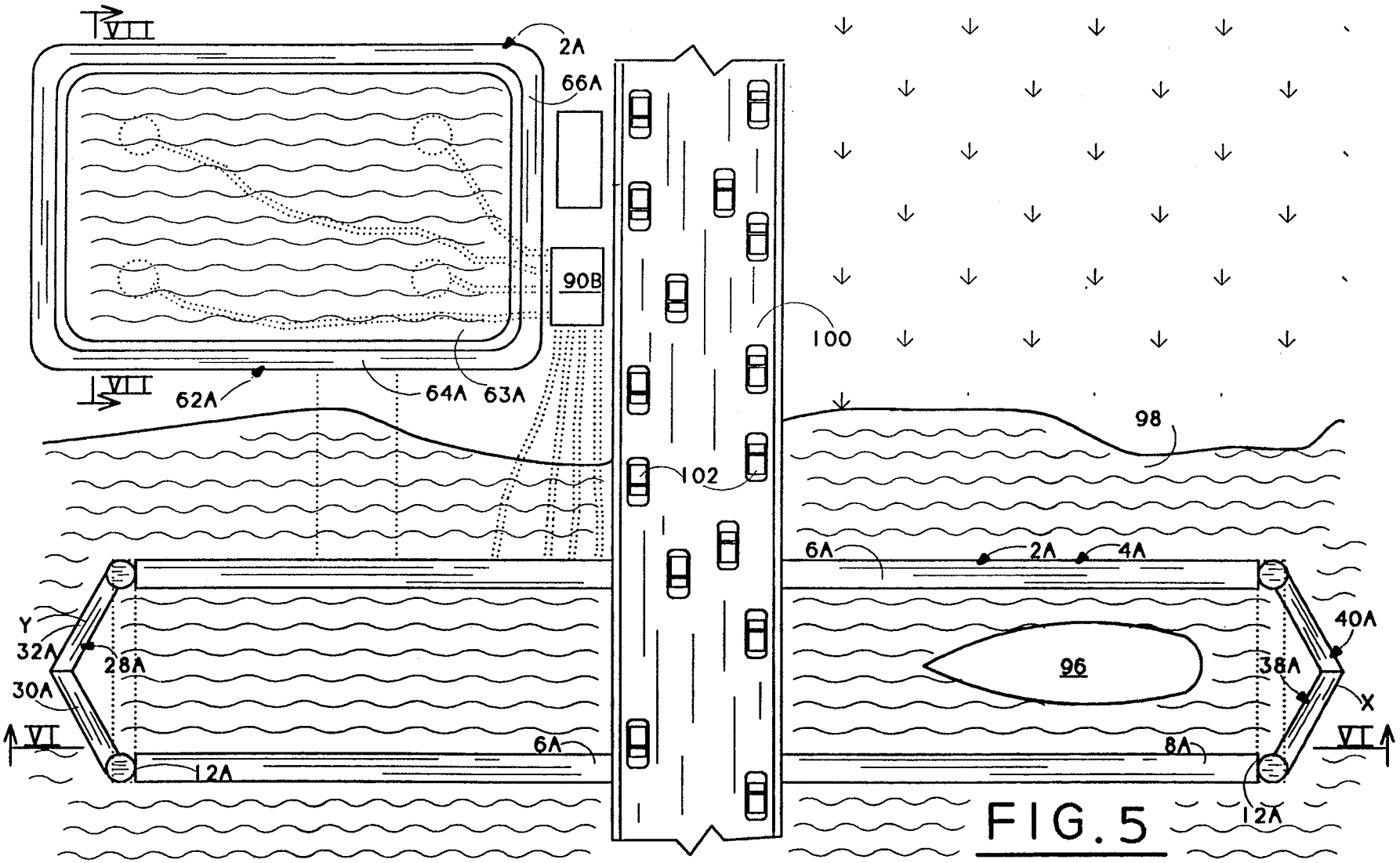
FIG. 5 is a plan view of another embodiment of a lock system of the invention associated with a bridge over a waterway.

A second embodiment of lock system 2A of the invention is illustrated in FIGS. 5–8 for a different purpose than lifting or lowering a ship from one waterway level to another. In this case, the lock system 2A permits a ship 96 floating in the waterway 98 to pass by the fixed bridge 100 carrying vehicular traffic 102 by going beneath the bridge which does not provide sufficient clearance for such passage in the absence of the lock system 2A.

The lock system 2A differs not only in function, but also construction from system 2. Thus, while the balance chamber 62 of system 2 mimics the lock chamber 4 in shape, balance chamber 62A of system 2A, because of available support land limitations, is considerably different in shape from lock chamber 4A. However, the critical components of the two separate systems are functionally equivalent.

The lock chamber 4A is functionally formed like lock chamber 4, but 4A is narrower than 4 relative to length to enable 4A to accept ships of all lengths, likely to travel waterway 98, between ends X or Y and the bridge 100.

The lock chamber 4A of lock system 2A comprises a pair of parallel vertical rectangular elongated walls 6A partially defined by longitudinal top edges 8A and opposed vertical first sides 12A.

There is a first end wall 14A and a second end wall 16A, each bounded by top edges 18A, bottom edges 20A, and opposed vertical second sides 22A of lesser height than the sides 12A of the walls 6A.

A horizontal bottom 24A, that joins with the walls 6A and the end walls 14A, 16A, creates the lock chamber 4A.

A first gate 28A includes a pair of doors 30A each bounded by top edges 32A, bottom edges 34A and vertical sides 36A of height equal to the height of the first sides 12A of the walls 6A minus the height of the second side 14A. Each door 30A is hinged at a side 36A to a side 12A above the top edge 18A of the end wall 14A.

A second gate 38A includes a pair of doors 40A each constructed like the first gate 28A and hinged at a side 42A to a side 12A of the walls 6A above the top edge 18A of the second end wall 16A.

A horizontal, vertically movable first floor 44A is positioned within the lock chamber 4A and comprises truss member 44B and top surface web 44C. It has an area conforming to, but slightly less, than the horizontal cross-sectional area of the lock chamber 4A.

Inflatable gasket means 46A is associated with the periphery 47A of the floor 44A to prevent liquid supported thereby from flowing below its level and to form a variable volume first pressure compartment 49A between the floor 44A and the bottom 24A.

First hydraulic means 50A is included to positively raise and lower the floor 44A. Means 50A includes a plurality of double-action first hydraulic cylinders 52A connected by vertical piston rods 54A to the truss member 44B of the floor 44A. The cylinders 52A contain a pull chamber (not shown) that imparts a downward pull on its respective piston rod 54A and a push chamber (not shown) that imparts an upward push on its respective piston rod 54A.

Cylinders 52A sit on bases 55A that are equipped with caissons 57A.

The lock system 2A also comprises a balance chamber 62A defined by an open top 63A, a pair of vertical side walls 64A, a pair of vertical end walls 66A and a horizontal second bottom 68A joins with the balance chamber side walls 64A and end walls 66A to provide the chamber 62A.

There is a horizontal, vertically movable floor 72A within the balance chamber 62A having an area conforming to, but slightly less, than the horizontal cross-sectional area of the balance chamber 62A. Although the floor 72A is different in shape from floor 44A, the area of floor 72A is substantially equal to the area of floor 44A.

Floor 72A is constructed to contain concrete slabs 72B beneath the surface web 72C so as to increase its weight in order to provide proper balance in the lock system 2A with floor 44A since floor 72A is designed to carry a column of water of lesser height than the column of water carried by floor 44A. This is done to utilize air space above balance chamber 62A for a parking garage. The total weight of slabs 72B should substantially equal the weight of the water column supported by floor 44A that exceeds the weight of the water column supported by floor 72A.

Inflatable gasket means 46A is associated with the periphery of the second floor 72A to prevent liquid supported thereby from flowing below its level and to form a variable volume second pressure compartment 74A between the floor 72A and the bottom 68A.

Second hydraulic means 76A serves to positively raise and lower the floor 72A and includes a plurality of double-action hydraulic cylinders 78A connected by vertical piston rods 80A to the underside 82A of the floor 72A. Cylinders 78A sit on bases 55A equipped with caissons 57A.

The cylinders 78A contain a pull chamber (not shown) that imparts a downward pull on its respective piston rod 80A and a push chamber (not shown) that imparts an upward push on its respective piston rod 80A.

The pull chambers of all the cylinders 52A are connected by first conduit means 86A to all the pull chambers of all the hydraulic cylinders 78A for fluid flow therebetween. The push chambers of all the hydraulic cylinders 52A are connected to the push chambers of the hydraulic cylinders 78A by second conduit means 88A for fluid flow therebetween.

The conduit means 88A includes a hydraulic pressure unit 90A with pump means (not shown) contained in pump house 90B for forcing fluid from the first hydraulic cylinders 52A to the second hydraulic cylinders 78A or vis versa.

Conduit means 94A connects the first pressure compartment 49A of lock chamber 4A to the second pressure compartment 74A of the balance chamber 62A for flow of pressurized air between them as the floors 44A & 72A are raised or lowered by their respective hydraulic means 50A & 76A.

Since the major portion of the balance chamber 62A is situated below ground level 103 adjacent the waterway 98, groundwater can cause chamber 62A to float so ground anchors 104 and 106 are used to hold it in position.

THE EMBODIMENTS OF THE INVENTION IN WHICH AN EXCLUSIVE PROPERTY OR PRIVILEGE IS CLAIMED ARE DEFINED AS FOLLOWS:

1. A balanced marine lock system comprising: a lock chamber defined by:

a pair of parallel vertical rectangular elongated walls each bounded by longitudinal horizontal top and bottom edges and opposed vertical first sides, first and second end walls each bounded by top and bottom edges shorter in length than said edges of said elongated walls and opposed vertical second sides of lesser height than said first sides of said elongated walls, said second sides being joined to said first sides with said longitudinal bottom edges and said shorter bottom edges all lying in a horizontal plane, a horizontal first bottom whose periphery joins with said elongated walls and said end walls, a first gate including a pair of doors each bounded by top and bottom edges and vertical third sides of height equal to the height of said first sides of said elongated walls minus said height of said second sides of said end walls, each said door being hinged at its said third side to a first side of said elongated walls above said top edge of said first end wall, a second gate including a pair of doors each constructed like said first gate and being hinged at its said third side to a first side of said elongated walls above said top edge of said second end wall, a horizontal vertically movable first floor within said lock chamber having an area conforming to, but slightly less, than the horizontal cross-sectional area of said lock chamber, inflatable gasket means associated with the periphery of said first floor to prevent liquid supported thereby from flowing below its level and to form a variable volume first pressure compartment between said first floor and said first bottom, and first hydraulic means to positively raise and lower said first floor, a balance chamber defined by:

a pair of vertical side walls, a pair of vertical end walls, a horizontal second bottom whose periphery joins with said balance chamber vertical walls and end walls and a open top, a horizontal vertically movable second floor within said balance chamber having an area conforming to, but slightly less, than the horizontal cross-sectional area of said balance chamber, said area of said second floor being substantially equal to said area of said first floor, inflatable gasket means associated with the periphery of said second floor to prevent liquid supported thereby from flowing below its level and to form a variable volume second pressure compartment between said second floor and said second bottom, second hydraulic means to positively raise and lower said second floor, and conduit means connecting said first pressure compartment to said second pressure compartment for flow of pressurized air between them.

2. A balanced marine lock system comprising:

a lock chamber defined by an open top, a pair of longitudinal parallel vertical walls, a pair of vertical gated end walls and a horizontal first bottom, a horizontal vertically movable first floor within said lock chamber having an area conforming to, but slightly less, than the horizontal cross-sectional area of said lock chamber, inflatable gasket means associated with the periphery of said first floor to prevent liquid supported thereby from flowing below its level and to form a variable volume first pressure compartment between said first floor and said first bottom, and first hydraulic means to positively raise and lower said first floor, a balance chamber defined by a open top, a pair of vertical side walls, a pair of vertical end walls, and a horizontal second bottom, a horizontal vertically movable second floor within said balance chamber having an area conforming to, but slightly less, than the horizontal cross-sectional area of said balance chamber, inflatable gasket means associated with the periphery of said second floor to prevent liquid supported thereby from flowing below its level and to form a variable volume second pressure compartment between said second floor and said second bottom, second hydraulic means to positively raise and lower said second floor, and conduit means connecting said first pressure compartment to said second pressure compartment for flow of pressurized air between them.

3. The lock system of claim 2 wherein said first hydraulic means includes a plurality of double-action first hydraulic cylinders and said second hydraulic means includes a plurality of double-action second hydraulic cylinders.

4. The lock system of claim 3 wherein said first hydraulic cylinders are connected by vertical piston rods to the underside of said first floor and said second hydraulic cylinders are connected by vertical piston rods to the underside of said second floor.

5. The lock system of claim 4 wherein each of said first and second hydraulic cylinders contain a pull chamber that imparts a downward pull on its respective piston rod and a push chamber that imparts an upward push on its respective piston rod.

6. The lock system of claim 5 wherein said pull chambers of all said first and second hydraulic cylinders are connected together by first conduit means for fluid flow therebetween.

7. The lock system of claim 6 wherein said push chambers of all said first and second hydraulic cylinders are connected together by second conduit means for fluid flow therebetween and said second conduit means includes pump means for forcing fluid from said first hydraulic cylinders to said second hydraulic cylinders or vis versa.

8. A method of operation of marine locks which comprises:

supporting a first column of water within a lock chamber upon a vertically movable first floor, supporting a second column of water within a balance chamber upon a vertically movable second floor, supporting said first and second floors upon a confined volume of compressed air communicated between said lock chamber and said balance chamber and in a first mode of said operation, causing said first floor to rise by application of upward hydraulic pressure on said first floor while causing said second floor to descend by application of downward hydraulic pressure on said second floor.

9. The method of claim 8 wherein the areas of said first and second floors are substantially equal and the heights of said first and second columns of water are substantially equal.

10. The method of claim 8 wherein during a second mode of said operation, causing said first floor to descend by application of downward hydraulic pressure on said first floor while causing said second floor to rise by application of upward hydraulic pressure on said second floor.

11. The method of claim 10 wherein said applications of hydraulic pressure are obtained by first double-action hydraulic cylinders attached to said first floor and second double-action hydraulic cylinders attached to said second floor.

* * * * *